US006799690B2

(12) United States Patent
de Pous et al.

(10) Patent No.: US 6,799,690 B2
(45) Date of Patent: Oct. 5, 2004

(54) ATTACHMENT DEVICE TO ATTACH A PUMP OR VALVE ONTO A RECIPIENT NECK

(75) Inventors: Olivier de Pous, Paris (FR); Jean-Jacques Ligny, Evreux (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/775,949

(22) Filed: Feb. 2, 2001

(65) Prior Publication Data

US 2001/0037990 A1 Nov. 8, 2001

(30) Foreign Application Priority Data

May 5, 2000 (FR) ..... 00 05877
Nov. 7, 2000 (FR) ..... 00 14259

(51) Int. Cl.[7] ..... B65D 45/34
(52) U.S. Cl. ..... 215/274; 222/153.11
(58) Field of Search ..... 215/272, 274, 215/319, 324; 222/153.11, 321.7, 321.9, 153.1; 220/320, 794, 309.1, 319

(56) References Cited

U.S. PATENT DOCUMENTS 3,159,318 A * 12/1964 Green ..... 222/402.18
3,248,021 A * 4/1966 Corsette et al. ..... 222/153.13
4,984,702 A * 1/1991 Pierpont ..... 215/272
5,069,369 A * 12/1991 McGarvey ..... 222/312.9
5,192,006 A * 3/1993 Van Brocklin et al. .. 222/321.9
5,299,703 A * 4/1994 Cater ..... 215/274
5,772,080 A 6/1998 de Pous et al.
5,799,810 A 9/1998 de Pous et al.
6,253,941 B1 * 7/2001 VanBrocklin et al. ..... 215/274
6,315,169 B1 * 11/2001 de Rosa ..... 215/272

FOREIGN PATENT DOCUMENTS

FR 2 737 471 2/1997

OTHER PUBLICATIONS

"Rapport De Recherche Préliminaire" from FR 0005877.

* cited by examiner

*Primary Examiner*—Lien Ngo
(74) *Attorney, Agent, or Firm*—Wood, Phillips, Katz, Clark & Mortimer

(57) ABSTRACT

An attachment device is provided to attach a distribution device, such as a pump or a valve, onto a neck of a recipient. The attachment device comprises a ring forming a skirt equipped with an attachment structure, such as clip-on heads, designed to co-operate with the neck of the recipient. A reception structure is provided to receive the distribution device. An annular plate extends radially inwards from the skirt. The plate is designed to be pressed against the upper end of the neck, with an inserted seal if required. The plate can be moved axially upwards away from the attachment structure by pressing the plate on the upper end of the neck.

2 Claims, 5 Drawing Sheets

ATTACHMENT DEVICE TO ATTACH A PUMP OR VALVE ONTO A RECIPIENT NECK

TECHNICAL FIELD

The present invention relates to an attachment device to attach a pump or a valve onto the neck of a recipient. Such an attachment device is more commonly referred to as an attachment ring or drum and is generally made of molded plastic. The attachment ring forms a skirt equipped with screw-on or clip-on attachment means designed to co-operate with the neck of the recipient. In addition, the ring comprises a housing designed to receive the body of the valve or pump. The ring also comprises an annular plate, the lower surface of which rests against the upper end of the neck. If required, a seal may be inserted between the plate and upper end of the neck. This is a conventional design for an attachment ring used in the perfume, cosmetic and pharmaceutical industries to attach a valve or a pump onto the neck of a recipient. The document EP-0 290 431 describes for example an attachment ring in which the skirt forms lugs which, before the assembly onto the neck of a recipient, comprises outward projections. The attachment device according to this document also uses a hoop to push back the outward projections of the lugs inwards below the neck by material flow. The lugs formed by the skirt are therefore deformed by the hoop, which presses the ring onto the neck of the recipient. The ring rests on the neck either at the inner surface of the skirt which forms a tapered surface, or at the lower surface of the plate which is supported on the upper end of the neck. The principle used for the attachment according to this document is based on the material flow deformation of the lugs formed by the skirt to press the ring in a tight fashion onto the neck of the recipient, using a hoop. It is important to note, in this document, that it is not necessary to have a seal which is normally inserted between the plate and the upper end of the neck.

SUMMARY OF THE INVENTION

The purpose of the present invention is to define an attachment device wherein the skirt of the ring does not undergo any deformation when it is attached onto the neck of a recipient, while producing effective tightness, advantageously without the use of a seal.

To do this, the present invention proposes an attachment device to attach a distribution device such as a pump or a valve onto a neck of a recipient, said attachment device comprising a ring forming a skirt equipped with attachment means designed to co-operate with the neck of the recipient, reception means designed to receive the distribution device and an annular plate extending radially outwardly from the reception means toward the skirt, said plate comprising a lower surface designed to be pressed against the upper end of the neck, with an inserted seal if required, wherein it is possible to move the plate axially upwards away from the attachment means by pressing the plate on the upper end of the neck. Advantageously, the plate is connected to the skirt by a deformable flexible connection. Preferentially, the deformable connection has a thin surface in relation to the plate such that the deformation takes place at the connection. According to a practical embodiment, the deformable connection is formed by a peripheral annular recess provided in the plate to reduce the plate surface thickness locally in a circular fashion.

Preferentially, the plate is rigid except for the deformable flexible connection. In this way, only the flexible connection undergoes deformations while the plate and the skirt remain undeformed. The flexible connections also makes it possible to compensate or correct any precision defect in the neck, which occurs frequently.

According to one embodiment, the attachment means comprise clip-on lugs equipped at their lower ends with clip-on heads designed to be inserted under the neck of the recipient. In addition, the addition device comprises a hoop fitted onto the ring to lock the clip-on heads under the neck. The hoop is no longer used to deform the skirt or clip-on lugs, given that the deformation is carried out at the flexible connection between the skirt and the plate.

The present invention also relates to an attachment device to attach a distribution device, such as a pump or a valve, onto a neck of a recipient, said attachment device comprising a ring formed by an attachment bushing and a reception sleeve, the bushing forming a skirt equipped with attachment means designed to co-operate with the neck of the recipient, a reception sleeve forming reception means designed to receive the distribution device and an annular plate extending radially outwards from the reception means toward the skirt, said plate comprising a lower surface designed to be pressed against the upper end of the neck, with an inserted seal if required, characterized in that the bushing comprises a support flange which extends inwards above the plate, elastic means being inserted between the flange and the plate such that it is possible to move the plate axially towards the flange by compressing the elastic means. Advantageously, the elastic means comprise several elastic blocks distributed on the circumference. Preferentially, the elastic means form one piece with the seal. According to a practical embodiment, the seal forming one piece with the elastic means is mounted over the ring plate.

According to one embodiment, the attachment means comprise clip-on lugs equipped at their lower ends with clip-on heads designed to be inserted under the neck of the recipient. In addition, the attachment device comprises a hoop fitted onto the ring to lock the clip-on heads under the neck. The hoop is no longer used to deform the skirt or clip-on lugs, given that the deformation is carried out at the flexible connection between the skirt and the plate.

BRIEF DESCRIPTION OF THE DRAWINGS

The present invention will now be described in more detail with reference to the attached figures, given as a non-restrictive example of an embodiment of the invention.

In the figures.

DETAILED DESCRIPTION OF THE PREFERRED EMBODIMENT

Figure 1:
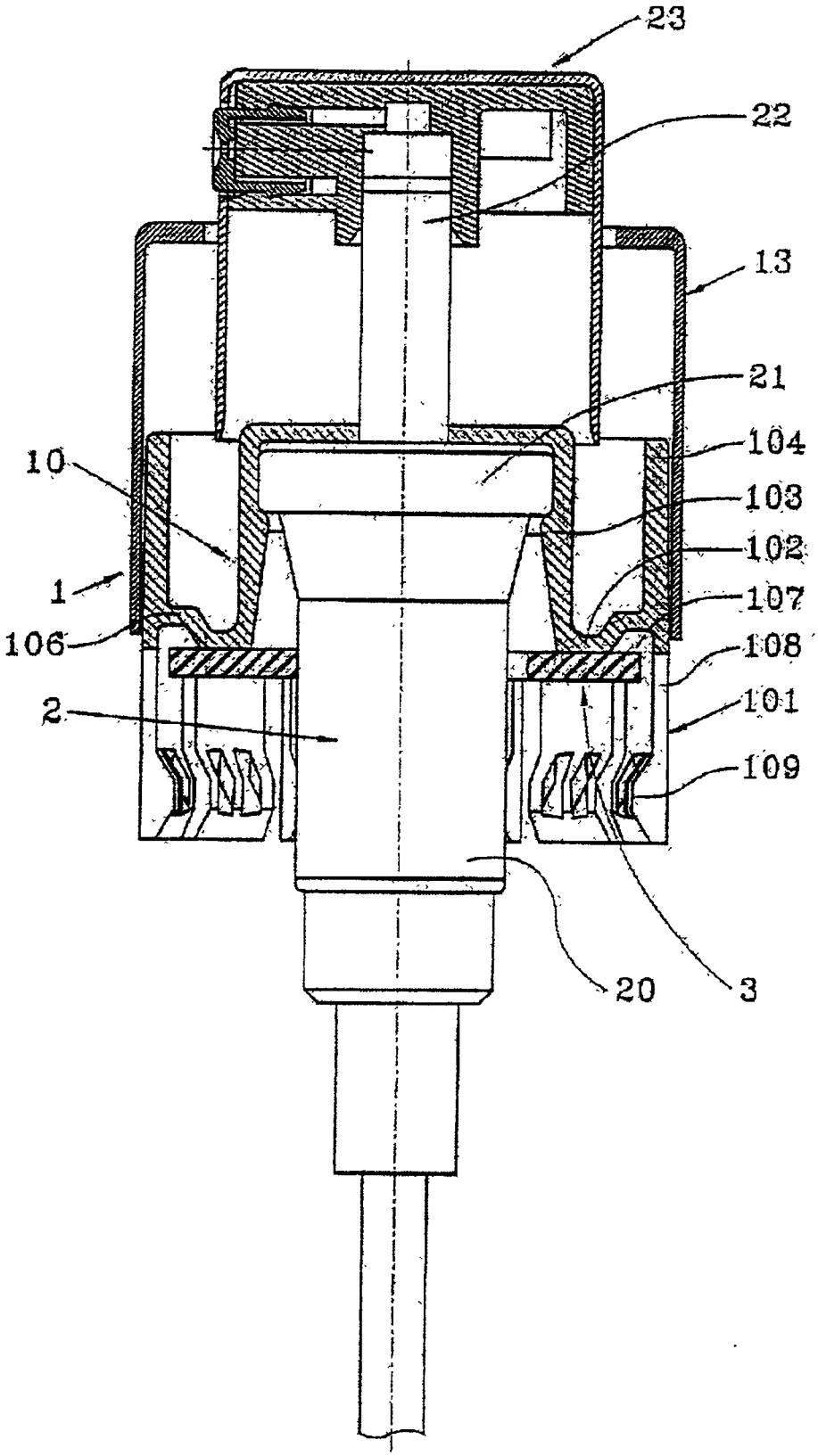
FIG. 1 is a vertical transversal section view of an attachment device according to the invention wherein a distribution device is fitted.

The attachment device shown in the different figures comprises two separate constituents, i.e. an attachment ring 10 and a hoop 13. This is a non-restrictive example of an embodiment and an attachment device without a hoop could be envisaged. In this case, the ring 10 alone ensures the attachment of the distribution device onto the neck of the recipient.

The ring 10, which may be made of molded plastic, forms a single-piece body which comprises several parts. In this way, the ring 10 forms a skirt 101 which is equipped with attachment means designed to co-operate with a neck of a recipient. Said attachment means may be very varied, such as screw-on or clip-on means. In the examples of embodiments shown in the figures, the attachment means comprise clip-on heads 109 arranged near the free lower end of the lugs 108. The skirt 101 is, as a result, composed of a plurality of lugs 108 arranged side by side but separated by spaces extending vertically. It is understood that the clip-on heads 109 located at the free ends of the lugs 108 have a certain degree of freedom, particularly in the radial direction.

Figure 2:
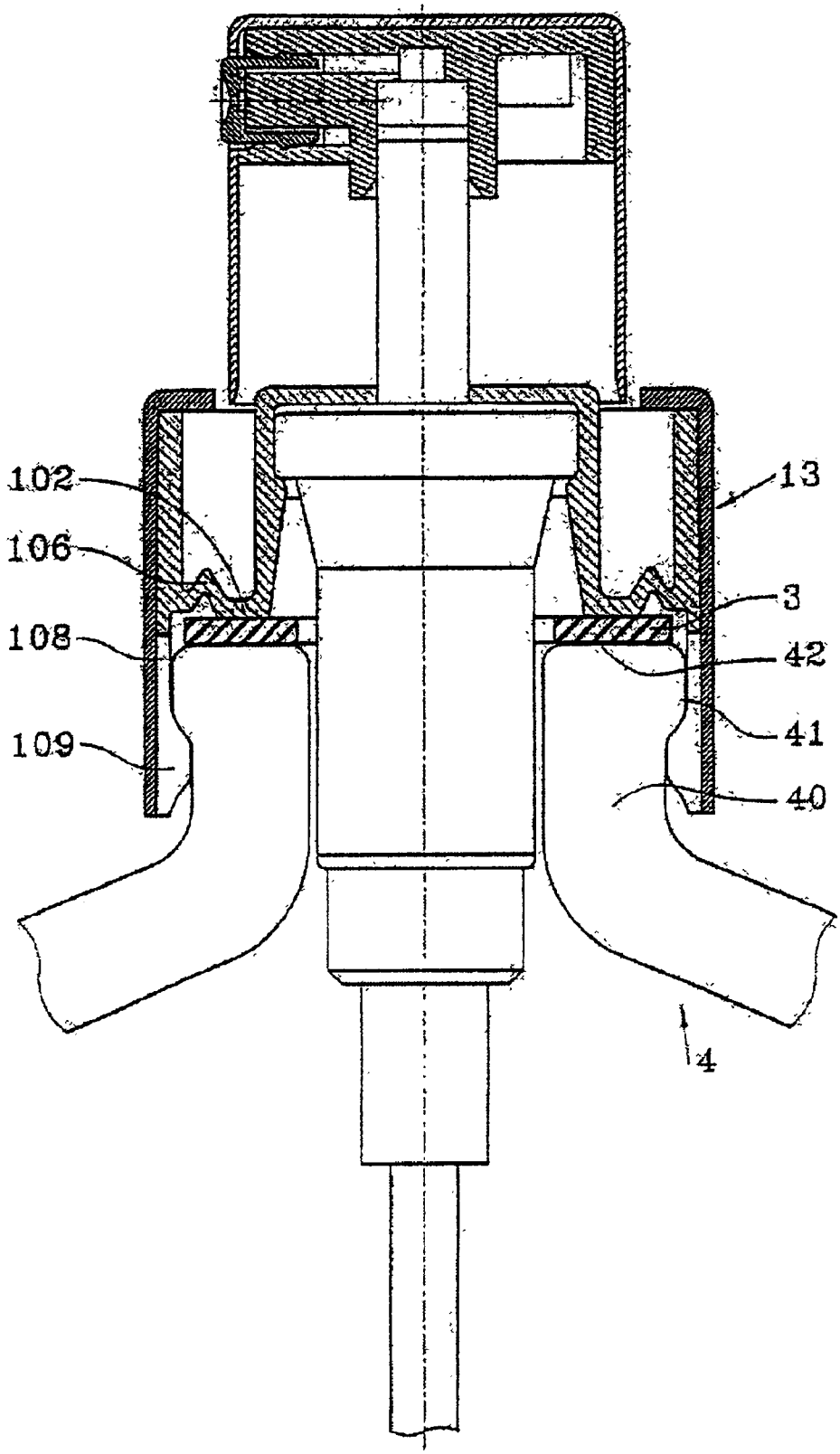
FIG. 2 is a view of the distribution device in FIG. 1 fitted on a neck of a recipient.

In general, a neck of a recipient, as shown in FIG. 2 and referred to by the numerical reference 40, forms a thickened rim 41 projecting outwards. In this case, the clip-on heads 109 are designed to be housed below the thickened rim 41 formed on the neck 40. Naturally, when the heads pass the rim 41, they must be forced outwards, which is possible due to the relative flexibility of the lugs 108. It is important to note that this is only a specific embodiment for the means to attach the ring onto the neck of the recipient. The skirt may, for example, be entirely cylindrical with a continuous internal clip-on cord. The skirt may also form an internal thread designed to co-operate with a threaded neck. The skirt is extended upwards with a bushing 104.

According to the invention, a plate 102 is connected to the skirt 101, or to the bushing 104, and preferentially at the join of the bushing and the skirt with a deformable flexible connection 106.

The plate 102 extends radially inwards from the deformable flexible connection 106. The plate 102 is extended inwards by a clip-on housing 103 which forms reception means for the body 20 of a distribution device 2, for example a pump. Conventionally, the housing 103 is designed to clip on a projecting flange 21 formed by the body 20. The housing 103 allows the passage of an actuating rod 22, on which a thruster 23 is fitted.

Given that the plate 102 has a flexible connection to the skirt 101, the plate 102 can move axially. In the idle state shown in FIG. 1, the flexible connection 106 forms a recess 107, which enables the plate 102 to be moved upwards without coming to a stop against the flexible connection 106. With reference to FIG. 2, which shows an attachment device fitted on the neck of a recipient, it can be seen that the flexible connection 106 due to the fact that the plate 102 is pressed upwards by the upper end 42 of the neck 40 by means of the seal 3 which may be omitted if required. This results in the plate 102 moving in relation to the skirt 101 and, consequently, in relation to the attachment means formed by the clip-on heads 109. The flexible connection 106 forms a point of annular weakness on the join of the plate with the skirt 101 or the bushing 104. In this way, no other part of the attachment ring 10 undergoes deformation, the plate 102 remaining perfectly rigid and the clip-on heads 109 are not deformed at all under the thickened rim 41 of the neck 40. The hoop 13 which is fitted on the ring 10 to the clip-on heads 109 only locks said heads under the thickened rim 41 without deforming them. Therefore, the hoop 13 only has a technical locking function and not a cam function as in the document of the prior art described. The movement of the plate 102 is not limited, but depends directly on the deformability of the flexible connection 106. This makes it possible to compensate for precision defects on the neck 40.

Figure 3:
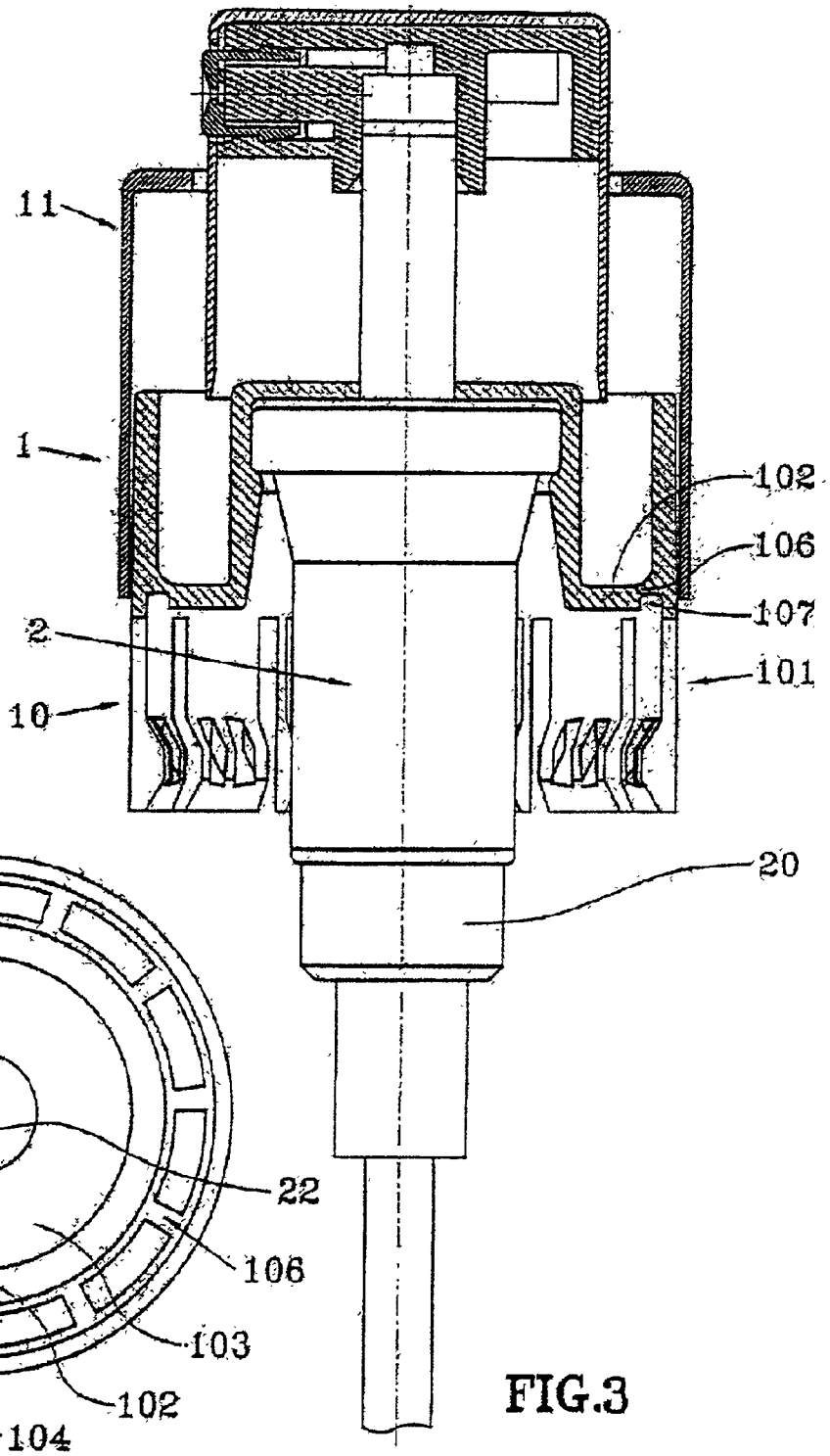
FIG. 3 is a vertical transversal section view of an attachment device produced according to a second embodiment of the invention.

We shall now refer to FIG. 3, which shows an alternative embodiment for the attachment ring 10. The attachment ring 10 is strictly identical to that in FIGS. 1 and 2 except on the flexible connection 106 which is produced with a local annular thinning of the plate 102 at its join on the skirt 101. This annular thinning 106 is produced by the formation of an annular recess 107 on the lower surface of the plate 102. The reduced surface thickness of the flexible connection 106 represents a point of weakness subject to deformation.

Figure 4:
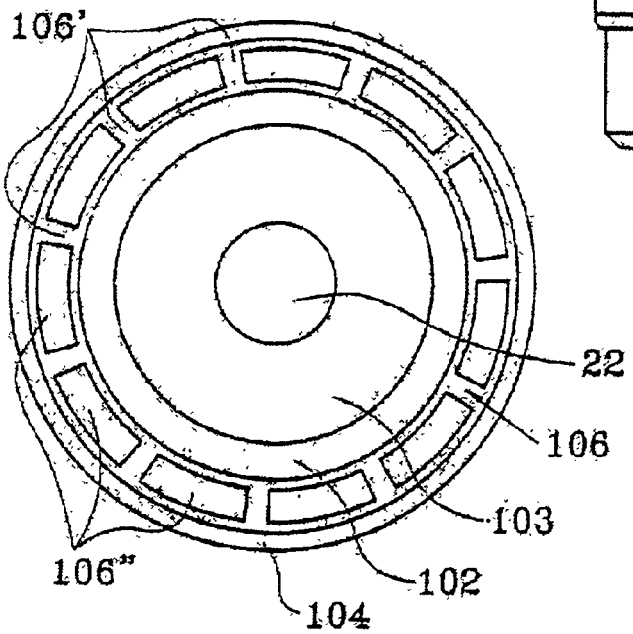
FIG. 4 is a top view of a ring plate according to a third embodiment.

The connection may be solid, but it may also be punched with gaps 106", as shown in FIG. 4. In this case, the connection 106 may come in the form of a plurality of radial spacers 106' joining the plate and the skirt. The principle of the present invention is based on the ability to move the plate 102 by deforming its connection with the skirt 101.

Figure 5:
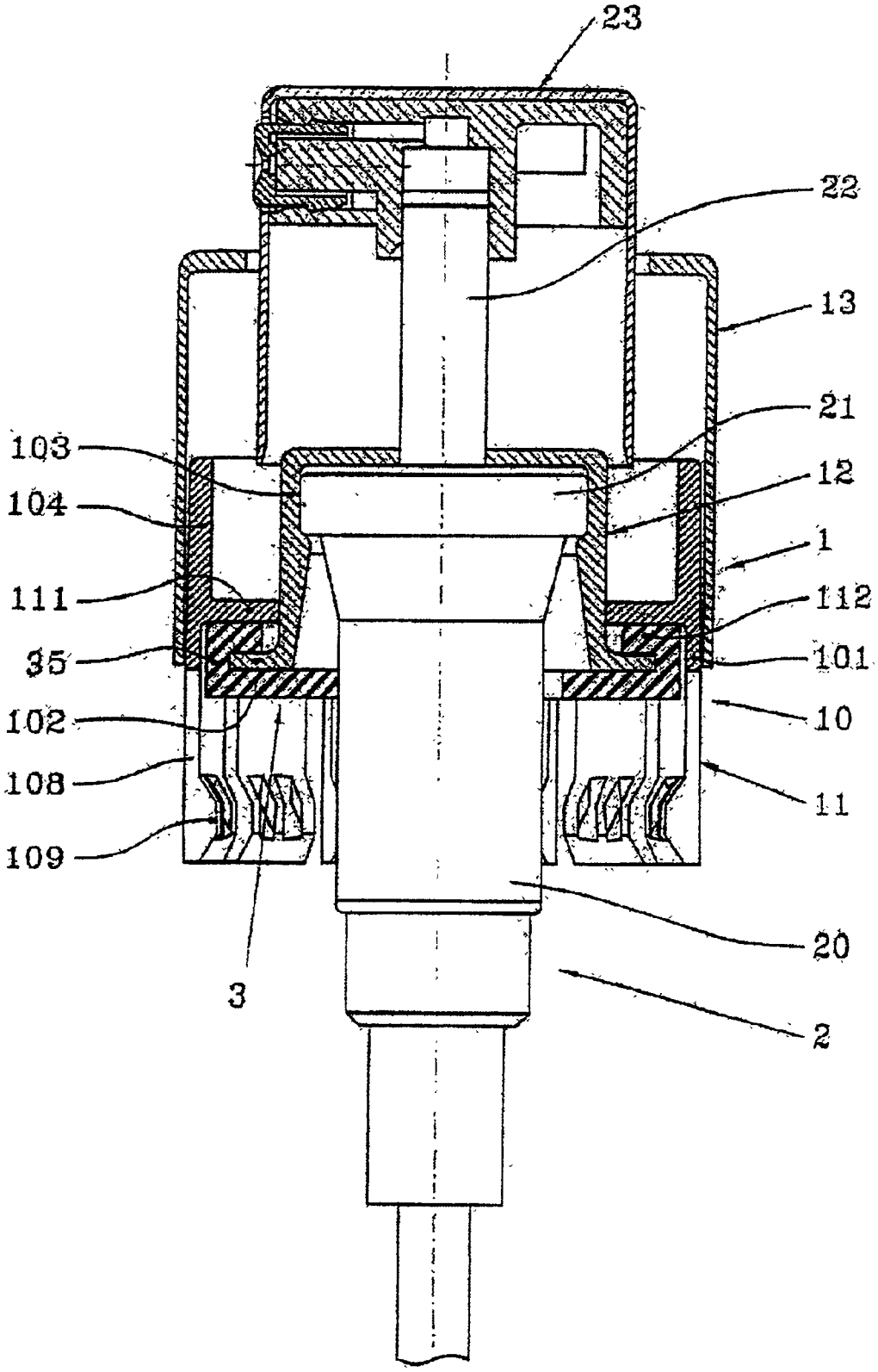
FIG. 5 is a vertical transversal section view of an attachment device according to a fourth embodiment of the invention wherein a distribution device is fitted.
Figure 6:
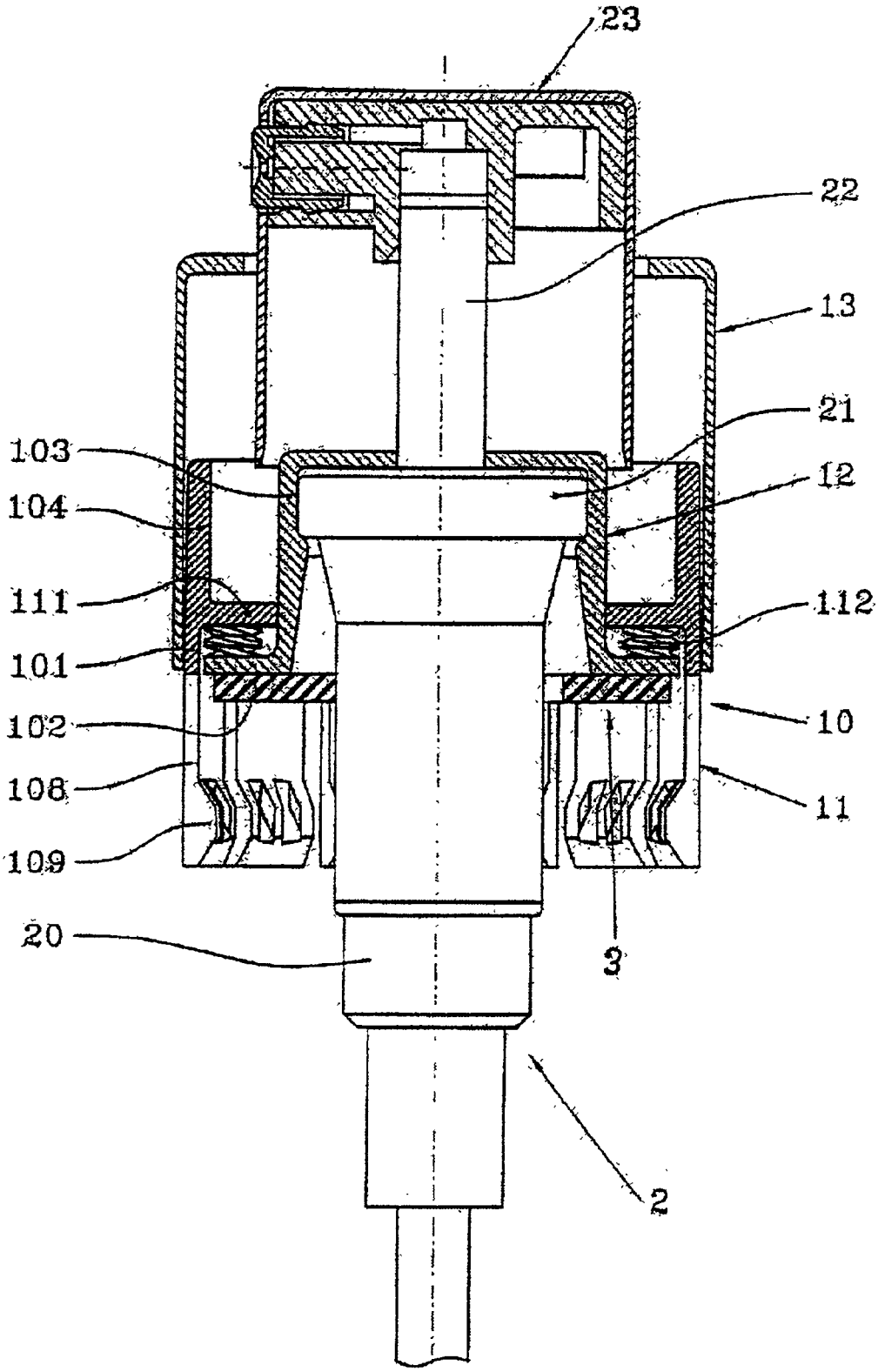
FIG. 6 is a vertical transversal section view of an attachment device produced according to a fifth embodiment of the invention.

In FIGS. 5 and 6, the attachment device comprises an attachment ring 10 made of two parts, i.e. an attachment bushing 11 and a reception sleeve 12. The bushing 11 forms a skirt 101 which is equipped with attachment means designed to co-operate with a neck of a recipient. Said attachment means may be the same, as in the embodiments of FIGS. 1 to 4.

In addition, the bushing comprises a support flange 111 which extends radially inwards. The flange 111 may extend on the circumference or the entire periphery of the skirt or only define segments distributed on the circumference.

The reception sleeve 12 defines a clip-on housing 103 which forms reception means for the body 20 of a distribution device 2, for example a pump. Conventionally, the housing 103 is designed to clip on a projecting reinforcement 21 formed by the body 20. The housing 103 allows the passage of an actuating rod 22, on which a thruster 23 is fitted. In addition, the sleeve 12 forms a plate 102 which extends radially outwards. The flange 111 extends above the plate 102 of the bushing 11.

According to the invention, the plate 102 is connected in a flexible fashion to the support flange. In this way, the plate 102 can be moved axially. More specifically, elastic means are inserted between the plate and the flange. The elastic means, when subject to compression, bring the plate and the flange closer together. This results in the plate 102 moving in relation to the skirt 101 and, consequently, in relation to the attachment means formed in this case by the clip-on heads 109. The elastic means may come in the form of small blocks of flexible material, advantageously distributed on the circumference. This is visible in FIG. 1. In an alternative shown in FIG. 3, the elastic means may come in the form of an extension of the neck seal 3 between the plate and the flange by surrounding the plate. This may advantageously be obtained by duplicate molding or double injection.

In this way, no other part of the attachment ring 10 undergoes deformation, the plate 102 remaining perfectly rigid and the clip-on heads 109 are not deformed at all under the thickened rim 41 of the neck 40. A hoop 13 is fitted on the ring 10 to the clip-on heads 109 to lock said heads under the thickened rim 41 without deforming them. Therefore, the hoop 13 only has a technical locking function and not a cam function as in the document of the prior art described. The movement of the plate 102 is not limited, but depends directly on the deformability of the flexible connection 106. This makes it possible to compensate for precision defects on the neck 40.

The principle of the present invention is based on the ability to move the plate in relation to the attachment means on the neck using elastic means inserted between the plate and the flange.

What is claimed is:

1. An attachment device (1) to attach a distribution device (2) onto a neck (40) of a recipient (4), comprising an upper end (42), said attachment device comprising a ring (10) defining a skirt (101) equipped with attachment means designed to co-operate with the neck (40) of the recipient (4), reception means (103) designed to receive the distribution device (1); and an annular plate (102) extending radially outwardly from the reception means (103) toward the skirt (101), said plate (102) being designed to be pressed against the upper end (42) of the neck (40), with an inserted seal (3) if required;

the plate (102) being connected to the skirt (101) by a deformable flexible connection (106), the connection (106) having an initial state when the attachment device (1) is not mounted on the recipient neck (40) and a final deformed state when the attachment device (1) is mounted on the recipient neck (40), said initial state of said connection (106) being offset axially further from said plate (102) in a step-like configuration, said final deformed state of said connection (108) having an inverted V-shaped cross-sectional configuration.

2. An attachment device (1) to attach a distribution device (2) onto a neck (40) of a recipient (4), comprising an upper end (42), said attachment device comprising a ring (10) defining a skirt (101) equipped with attachment means designed to co-operate with the neck (40) of the recipient (4), reception means (103) designed to receive the distribution device (1); and an annular plate (102) extending radially outwardly from the reception means (103) toward the skirt (101), said plate (102) being designed to be pressed against the upper end (42) of the neck (40), with an inserted seal (3) if required;

the plate (102) being connected to the skirt (101) by a deformable flexible connection (106), the connection (106) having an initial state when the attachment device is not mounted on the recipient neck (40) and a final deformed state when the attachment device is mounted on the recipient neck, said initial state of said connection (106) having a plurality of radial spacers (106') which join said plate (102) to said skirt (101) and which define a plurality of gaps (106") weakening said connection (106) for subsequently accommodating material flow deformation of the connection (106) to said final deformed state when the attachment device (1) is mounted on the recipient neck (40).

* * * * *